US005275497A

United States Patent [19]

Shiau

[11] Patent Number: 5,275,497

[45] Date of Patent: Jan. 4, 1994

[54] WRITING INSTRUMENT WITH LIGHT ASSEMBLY

[76] Inventor: Shoei-Shuh Shiau, No. 10, Alley 1, Lane 551, Sec. 1, Wan-Shou Rd., Guei-Shan Hsiang, Taoyuan Hsien, Taiwan

[21] Appl. No.: 59,823

[22] Filed: May 10, 1993

[51] Int. Cl.[5] ..... B43K 29/10

[52] U.S. Cl. ..... 401/195; 362/118

[58] Field of Search ..... 401/195; 362/118

[56] References Cited

U.S. PATENT DOCUMENTS 3,045,111 7/1962 Hoenig ..... 362/118 X

FOREIGN PATENT DOCUMENTS 584738 10/1959 Canada ..... 362/118
1018751 10/1957 Fed. Rep. of Germany ..... 362/118
1252096 10/1967 Fed. Rep. of Germany ..... 401/195

*Primary Examiner*—Steven A. Bratlie
*Attorney, Agent, or Firm*—Baker & Botts

[57] ABSTRACT

A writing instrument with a light assembly includes a barrel, a nib assembly, a lamp unit and a thrusting unit. The nib assembly includes a nib casing connected to an open lower end of the barrel and an ink tube with a writing tip disposed inside the nib casing. The ink tube is movable between a first position, wherein the writing tip is disposed in the nib casing, and a second position, wherein the writing tip extends out of the nib casing. The lamp unit is disposed operably inside the barrel. The thrusting assembly includes a cap member connected to an open top end of the barrel and a push-button provided on the cap member. The push-button is operable to move the ink tube between the first and second positions and to turn on the lamp unit when the ink tube is in the second position and turn off the lamp unit when the ink tube is in the first position.

2 Claims, 5 Drawing Sheets

WRITING INSTRUMENT WITH LIGHT ASSEMBLY

BACKGROUND OF THE INVENTION

1. Field Of The Invention

This invention relates to a writing instrument, more particularly to a writing instrument which has a light assembly.

2. Description Of The Related Art

Writing under the presence of insufficient light is harmful to the eyes. Even in the presence of an external light source, a dim area is still provided around the writing tip of a conventional writing instrument due to the shadow of the hand which holds the writing instrument.

SUMMARY OF THE INVENTION

Therefore, the main object of the present invention is to provide a writing instrument which incorporates a light assembly that is operable so as to provide additional light when writing.

According to this invention, a writing instrument with light assembly includes a conductive barrel, a nib assembly, a thrusting assembly and a lamp assembly. The conductive barrel has an open top end and an open bottom end. The nib assembly includes a hollow nib casing which is transparent and which has an open top end connected to the open bottom end of the barrel and a tapered open bottom end. An ink tube has an upper end and a lower writing tip and is disposed inside the nib casing. A coil spring is sleeved on the ink tube to bias the ink tube inwardly of the barrel. The ink tube is movable between a first position, wherein the writing tip is disposed in the nib casing, and a second position, wherein the writing tip extends out of the nib casing through the open bottom end of the latter. The thrusting assembly includes a hollow insulating cap member which has an open bottom end connected to the open top end of the barrel and which has an open top end. A push-button is provided on the open top end of the cap member and is operable to move the ink tube between the first and second positions. A conductive clip member is clamped between the cap member and the open top end of the barrel. A transparent push-member is disposed slidably inside the nib casing and has a lower end which abuts against the upper end of the ink tube. The lamp assembly includes an insulating lamp holder which is disposed slidably inside the barrel above the push-member and which has a lower end abutting against the push-member. The lamp holder retains a lamp therein. The lamp has a first electrode in electrical contact with the barrel and a second electrode. An insulating battery seat is disposed slidably inside the barrel above the lamp holder and has a lower end abutting against the lamp holder. The battery seat receives a battery therein. The battery has a first terminal connected electrically to the second electrode of the lamp and a second terminal. The battery seat further has a first conductive spring connected to the second terminal of the battery and so as to bias the battery toward the lamp holder. The thrusting assembly further includes an insulating switch bar which has an upper end extending into the cap member and which is in contact with the lower end of the push-button. The switch bar has a lower end extending into the barrel and is in contact with the battery seat. A conductive plate is positioned at the upper end of the switch bar. A second conductive spring is provided on the switch bar and interconnects the conductive plate and the first conductive spring to connect electrically the conductive plate and the second terminal of the battery. The switch bar is movable between a switch-off position, wherein the ink tube is in the first position and the conductive plate is spaced from the clip member to turn off the lamp, and a switch-on position, wherein the ink tube is in the second position and the conductive plate is in contact with the clip member to turn on the lamp.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
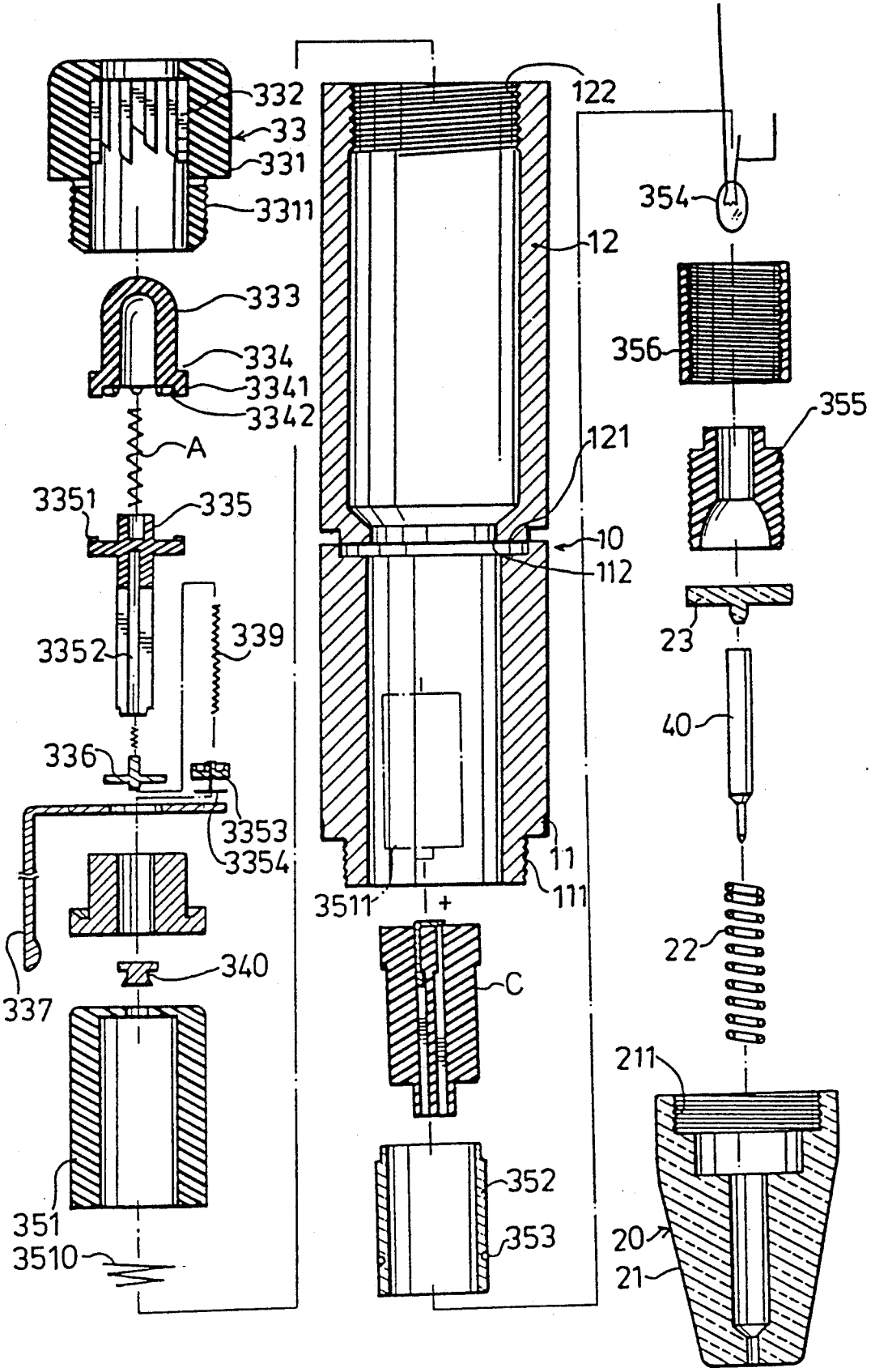
FIG. 1 is an exploded view of a writing instrument with a light assembly according to the present invention.
Figure 2:
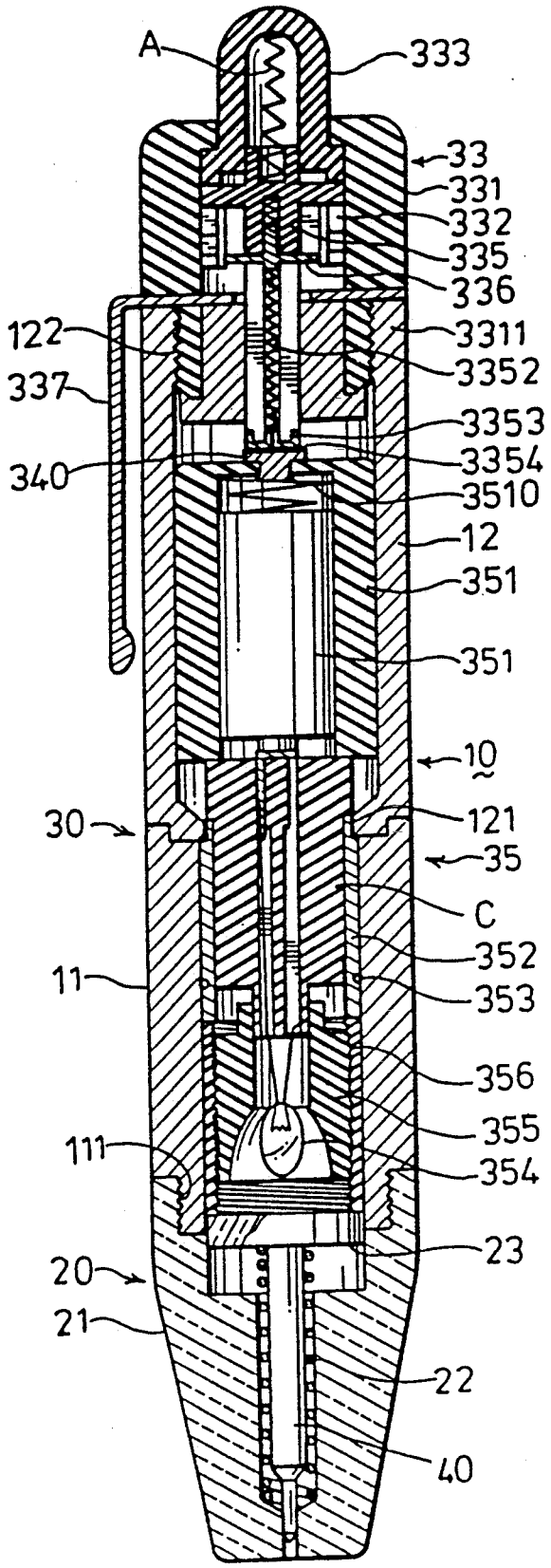
FIG. 2 is a sectional view of the writing instrument according to the present invention illustrating its assembly.

Referring to FIGS. 1 and 2, a writing instrument with light assembly according to this invention includes a conductive barrel (10), a nib assembly (20), a lamp assembly (30) and a thrusting assembly (33).

The conductive barrel (10) includes a first barrel section (11) and a second barrel section (12). The first barrel section (11) has an open bottom end (111) which is threaded externally and an open top end (112) which is threaded internally. The second barrel section (12) has an open top end (122) which is threaded internally and an open bottom end (121) which is threaded externally and which engages threadably the open top end (112) of the first barrel section (11).

The nib assembly (20) includes a transparent hollow nib casing (21) which is made of a plastic material, such as polycarbonate, and which has an open top end (211) connected to the open bottom end (111) of the barrel (10) and a tapered open bottom end. An ink tube (40) has an upper end and a lower writing tip and is disposed inside the nib casing (21). A coil spring (22) is sleeved on the ink tube (40) so as to bias the ink tube (40) inwardly of the barrel (10). A transparent push-member (23) is disposed slidably inside the nib casing (21) and has a lower end which abuts against the upper end of the ink tube (40). The ink tube (40) is movable between a first position, wherein the writing tip is disposed in the nib casing (21), and a second position, wherein the writing tip extends out of the nib casing (21) through the open bottom end of the latter.

The lamp assembly (30) includes an internally threaded tubular member (356) and an externally threaded light reflecting sleeve (355) that engages threadably the tubular member (356) in such a manner that the light reflecting sleeve (355) can be moved upward and downward relative to and inside the tubular member (356). The tubular member (356) is disposed slidably inside the first barrel section (11) of the barrel (10) above the push-member (23) and has a lower end abutting against the push-member (23). A conductive sleeve member (352) is sleeved on an insulating lamp holder (C) and is disposed slidably inside the first barrel section (11) of the barrel (10) above the tubular member (356). The sleeve member (352) has a lower end abutting against the tubular member (356). A lamp (354) is disposed inside the light reflecting sleeve (355) and has a first electrode in electrical contact with the sleeve member (352) and a second electrode. A conductive ring (353) is provided on an outer surface of the sleeve member (352) so as to ensure that the barrel (10) and the sleeve member (352) are in constant electrical contact. An insulating battery seat (351) is disposed slidably inside the second barrel section (12) of the barrel (10) above the lamp holder (C) and has a lower end abutting against the lamp holder (C). The battery seat (351) receives a battery (3511) therein. The battery (3511) has a first terminal connected electrically to the second electrode of the lamp (354) and a second terminal. A first conductive spring (3510) is disposed inside said battery seat (351) and is connected to the second terminal of the battery (3511) so as to bias the battery (3511) toward the lamp holder (C).

Figure 3:
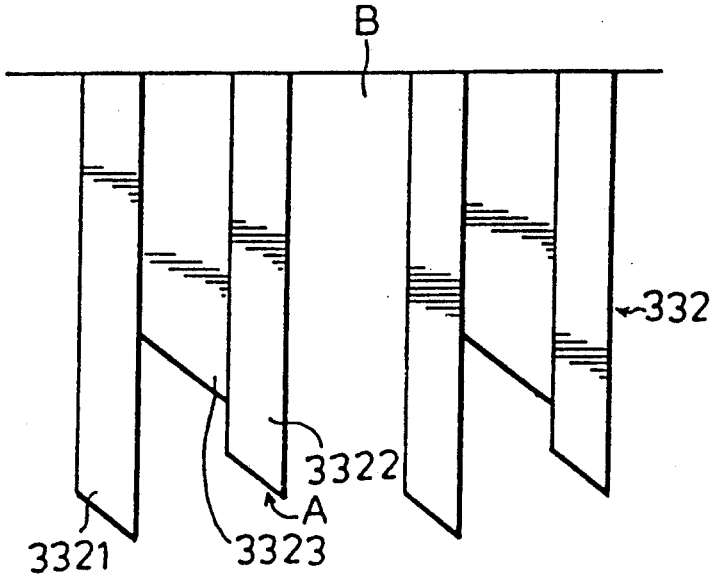
FIG. 3 is a fragmentary view in which an inner surface of the tubular wall of a cap member of the writing instrument according to the present invention is translated onto a plane.
Figure 4:
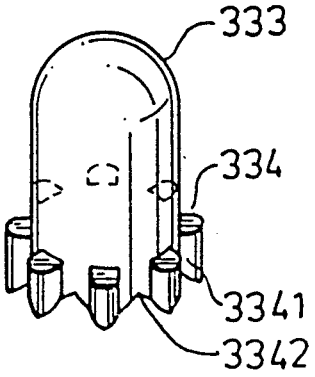
FIG. 4 is a perspective view showing a push-button of the writing instrument according to the present invention.
Figure 6B:
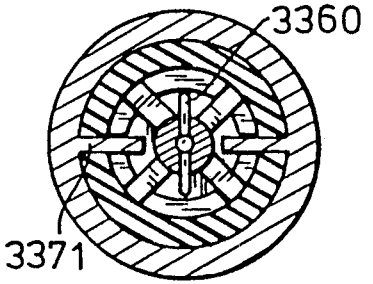
FIGS. 6A and 6B are sectional views showing an upper end portion of the writing instrument according to the present invention when the projections of the push-button are in a writing position.
Figure 7B:
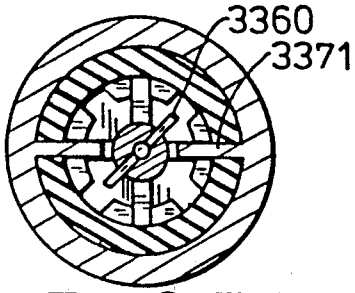
FIGS. 7A and 7B are sectional views showing an upper end portion of the writing instrument according to the present invention when the projections of the push-button are in another non-writing position.
Figure 8B:
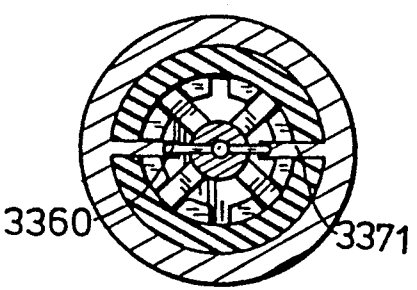
FIGS. 8A and 8B are sectional views showing an upper end portion of the writing instrument according to the present invention when the projections of the push-button are in a writing-and-lighting position.
Figure 9:
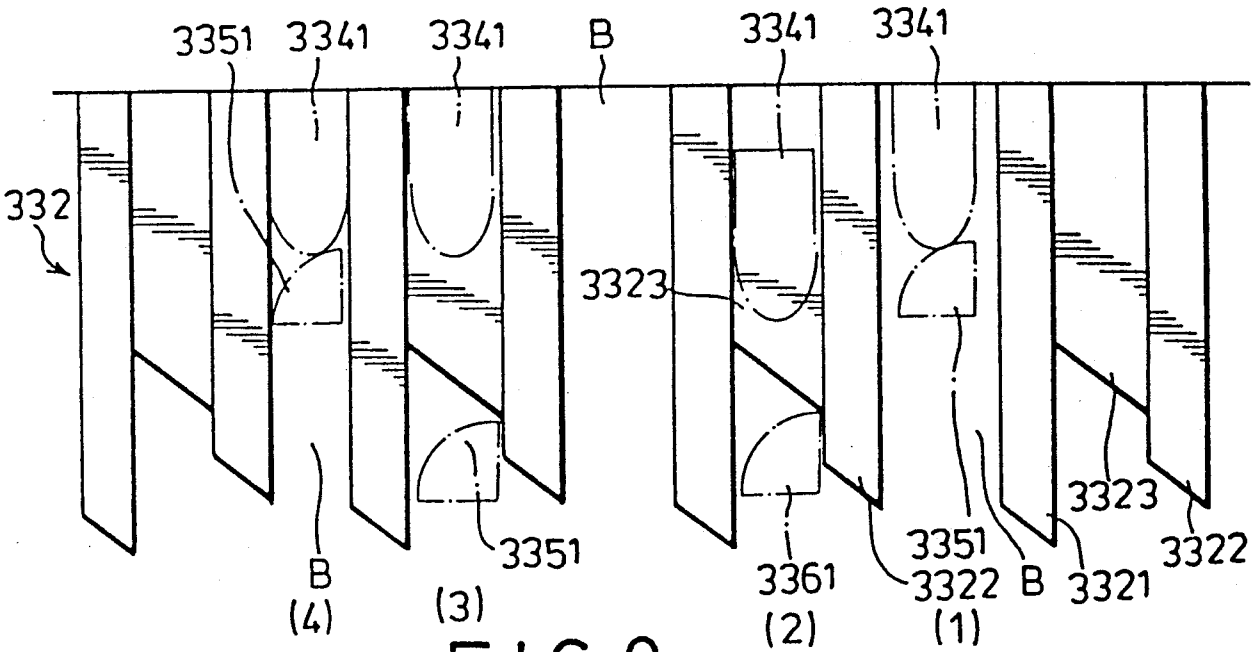
FIG. 9 is a view in which the inner surface of the tubular wall of the cap member of the writing instrument according to the present invention is translated onto a plane to illustrate operation of the same.

Referring to FIGS. 3, 4 and 9 and once more to FIGS. 1 and 2, the thrusting assembly (33) includes a hollow insulating cap member (331) which has an externally threaded open bottom end (3311) connected threadably to the open top end (122) of the barrel (10) and which has an open top end. A push-button (333) is provided operably on the open top end of the cap member (331). A metallic clip member (337) is clamped between the cap member (331) and the open top end (122) of the barrel (10). The clip member (337) has two opposed protrusions (3371) (see FIGS. 5A to 8B) that protrude radially inward therefrom. An insulating switch bar (335) has an upper end extending into the cap member (331) and a lower end extending into the second barrel section (12) of the barrel (10). A compression spring (A) is disposed between the push-button (333) and the upper end of the switch bar (335) so as to bias the push-button (333) outwardly of the cap member (331). The lower end of the push-button (331) is formed with a plurality of axially extending projections (3341). Each two adjacent projections (3341) cooperatively define an engaging space (3342) therebetween. The upper end of the switch bar (335) abuts against the lower end of the push-button (331) and has a flange extending radially outward therefrom. A plurality of upwardly extending projections (3351) are provided at the outermost end of the flange so as to engage selectively the projections (3341) of the push-button (333). The lower end of the switch bar (335) has a blind axial bore (3352) in which a second conductive spring (339) is provided. A conductive member (3353) is secured at the lowermost end of the switch bar (335) by a conductive fastener (3354) so as to prevent disengagement of the second conductive spring (339) from the bore (3352) through the lower end of the switch bar (335). A conductive plate (336) is positioned at the upper end of the switch bar (335) and has two opposed extensions (3360) (see FIGS. 5A to 8B) extending radially outward therefrom. The second conductive spring (339) is in contact with the conductive plate (336). A conductive coupling member (340) is positioned at an upper end of the battery seat (351) and extends into the battery seat (351) to couple with the first conductive spring (3510). The conductive member (3353) on the lowermost end of the switch bar (335) abuts against the coupling member (340) so as to connect electrically the second conductive spring (339) and the coupling member (340). The push-button (333) includes a retaining unit for retaining selectively the ink tube (40) in the first and second positions. The retaining unit includes a plurality of angularly spaced rib sets which are formed on the inner wall surface of the cap member (331). Each two adjacent rib sets cooperatively define a gap (B) therebetween. Each of the rib sets includes first, second and third side-by-side axially extending ribs (3321,3322,3323). The third rib (3323) is located between the first and second ribs (3321,3322). The first rib (3321) is longer than the second rib (3322). The second rib (3322) is longer than the third rib (3323). The first and second ribs (3321,3322) are thicker than the third rib (3323). Each of the ribs (3321,3322,3323) has an inclined lowermost end.

Figure 5B:
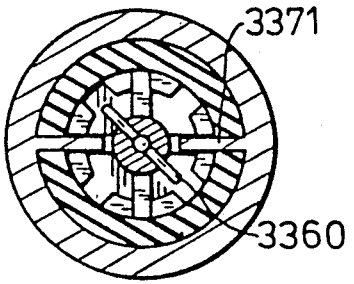
FIGS. 5A and 5B are sectional views showing an upper portion of the writing instrument according to the present invention when the projections of the push-button are in a non-writing position.
Figure 5A:
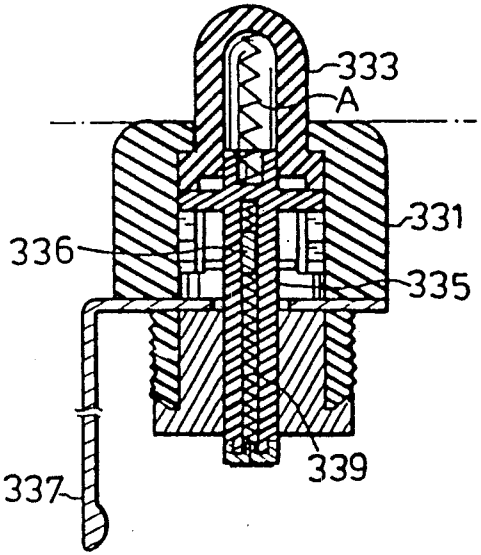
Figure 6A:
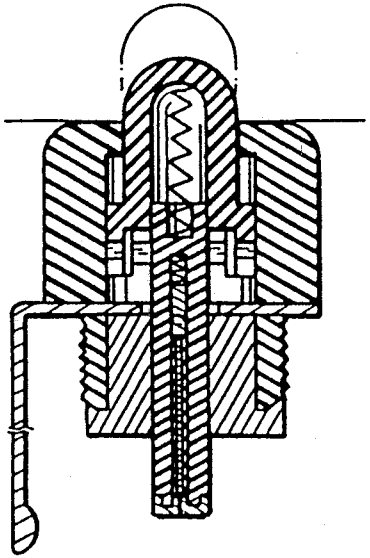
Figure 7A:
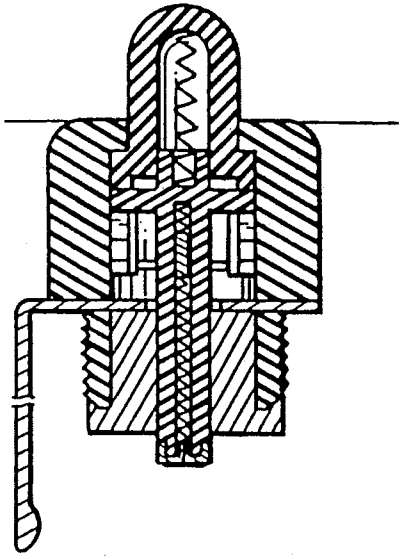
Figure 8A:
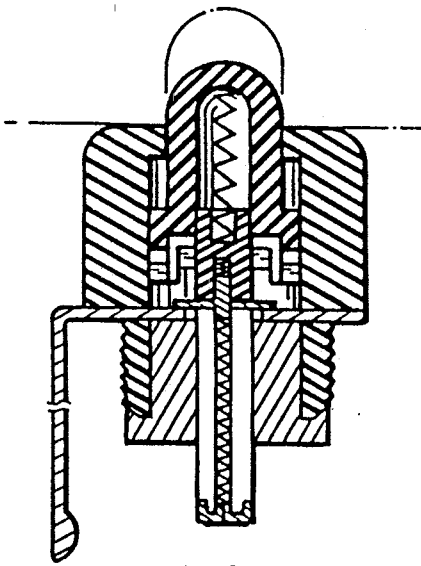

Referring to FIGS. 5A to 9, the projections (3341) of the push button (333) are movable among a non-writing position, a writing position and a writing-and-lighting position. As illustrated in FIGS. 5A and 5B, the projections (3341) are initially in the non-writing position, wherein the ink tube (40) is in the first position, the projections (3341) are located in the gaps (B), and the extensions (3360) of the conducting plate (336) are misaligned with and spaced from the protrusions (3371) of the clip member (337). When the push-button (333) is operated once, the projections (3341) are moved from the non-writing position to the writing position, wherein the ink tube (40) is in the second position, the projections (3341) engage the third ribs (3323), and the extensions (3360) of the conducting plate (336) are perpendicular to and spaced from the protrusions of the clip member (337), as best shown in FIGS. 6A and 6B. If the push-button (333) is operated once more, the projections (3341) are moved from the writing position to the non-writing position, as best illustrated in FIGS. 7A and 7B. At this stage, when the push-button (333) is operated again, the projections (3341) are moved from the non-writing position to the writing-and-lighting position, wherein the ink tube (40) is in the second position, the projections (3341) engage the third ribs (3323), and the extensions (3360) of the conducting plate (336) are aligned and in contact with the protrusions (3371) of the clip member (337) so as to turn on the lamp (354), as illustrated in FIGS. 8A and 8B.

Furthermore, the focus of the light assembly can be adjusted by moving the light reflecting sleeve (355) relative to the tubular member (356) so as to vary the distance between the light reflecting sleeve (355) and the lamp holder (C) in order to adjust the intensity of the light surrounding the writing tip of the ink tube (40).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A writing instrument with a light assembly, said writing instrument including a conductive barrel having an open top end and an open bottom end, a nib assembly including a hollow nib casing which has an open top end connected to said open bottom end of said barrel and a tapered open bottom end, an ink tube which has an upper end and a lower writing tip and which is disposed inside said nib casing, and a coil spring sleeved on said ink tube to bias said ink tube inwardly of said barrel, said ink tube being movable between a first position, wherein said writing tip is disposed in said nib casing, and a second position, wherein said writing tip extends out of said nib casing through said open bottom end of the latter, and a thrusting assembly including a hollow insulating cap member which has an open bottom end connected to said open top end of said barrel and which has an open top end, a push-button provided on said open top end of said cap member and operable so as to move said ink tube between said first and second position, and a metallic clip member clamped between said cap member and said open top end of said barrel, wherein the improvement comprises:

said nib casing being transparent;

a transparent push-member being disposed slidably inside said nib casing and having a lower end which abuts against said upper end of said ink tube;

a lamp assembly including an insulating lamp holder which is disposed slidably inside said barrel above said push-member and which has a lower end abutting against said push-member, said lamp holder retaining a lamp therein, said lamp having a first electrode in electrical contact with said barrel and a second electrode, said lamp assembly further including an insulating battery seat which is disposed slidably inside said barrel above said lamp holder and which has a lower end abutting against said lamp holder, said battery seat receiving a battery therein, said battery having a first terminal connected electrically to said second electrode of said lamp and a second terminal, said battery seat further having a first conductive spring connected to said second terminal of said battery to bias said battery toward said lamp holder;

said thrusting assembly further including an insulating switch bar which has an upper end extending into said cap member and which is in contact with said lower end of said push-button, said switch bar having a lower end extending into said barrel and being in contact with said battery seat, a conductive plate positioned at said upper end of said switch bar, and a second conductive spring which is provided on said switch bar and which interconnects said conductive plate and said first conductive spring to connect electrically said conductive plate and said second terminal of said battery, said switch bar being movable between a switch-off position, wherein said ink tube is in said first position and said conductive plate is spaced from said clip member to turn off said lamp, and a switch-on position, wherein said ink tube is in said second position and said conductive plate is in contact with said clip member to turn on said lamp.

2. A writing instrument with a light assembly as claimed in claim 1, wherein said hollow cap member has an inner wall surface, said push-button including a retaining unit for retaining selectively said ink tube in said first and second positions, said retaining unit including a plurality of angular spaced rib sets which are formed on said inner wall surface of said cap member, each two adjacent said rib sets cooperatively defining a gap therebetween, each of said rib sets including first, second and third side by side axially extending ribs, said third rib being located between said first and second ribs, said first rib being longer than said second rib, said second rib being longer than said third rib, said first and second ribs being thicker than said third axially extending rib, each of said ribs having an inclined lowermost end, said lower end of said push-button being formed with a plurality of axially extending projections which engage selectively said third ribs, said conducting plate having two opposed extensions extending radially outward therefrom, said clip member having two opposed protrusions protruding inwardly therefrom, said projections being movable among a non-writing position, wherein said ink tube is in said first position, said projections are located in said gaps, and said extensions of said conducting plate are misaligned with and spaced from said protrusions of said clip member, a writing position, wherein said ink tube is in said second position, said projections engage said third ribs, and said extensions of said conducting plate are perpendicular to and spaced from said protrusions of said clip member, and a writing-and-lighting position, wherein said ink tube is in said second position, said projections engage said third ribs, and said extensions of said conducting plate are aligned and in contact with said protrusions of said clip member.

* * * * *